United States Patent [19]

Maldonado

[11] Patent Number: 4,895,276

[45] Date of Patent: Jan. 23, 1990

[54] DUAL LIQUID CARTRIDGE DISPENSER

[75] Inventor: John E. Maldonado, San Antonio, Tex.

[73] Assignee: Sani-Fresh International, Inc., San Antonio, Tex.

[21] Appl. No.: 269,620

[22] Filed: Nov. 10, 1988

Related U.S. Application Data

[63] Continuation of Ser. No. 110,151; Oct. 19, 1987, abandoned.

[51] Int. Cl.[4] ..... B67D 5/60

[52] U.S. Cl. ..... 222/144.5; 222/185; 222/214; 251/9

[58] Field of Search ..... 222/144.5, 129, 214, 222/213, 182, 185, 181, 207; 251/4, 6, 7, 9

[56] References Cited

U.S. PATENT DOCUMENTS

| | | | |
|---|---|---|---|
| 2,619,386 | 11/1952 | Dalrymple | 299/140 |
| 3,193,143 | 7/1965 | Maieli | 222/144.5 |
| 3,679,331 | 7/1972 | Kushner | 222/214 |
| 4,130,224 | 12/1978 | Norman et al. | 222/185 |
| 4,513,885 | 4/1985 | Hogan | 222/185 |
| 4,621,749 | 11/1986 | Kanfer | 222/214 |

*Primary Examiner*—Joseph J. Rolla
*Assistant Examiner*—Kenneth Noland
*Attorney, Agent, or Firm*—Burns, Doane, Swecker & Mathis

[57] ABSTRACT

A dual cartridge dispenser. Each cartridge has an exit orifice through which fluid is dispensed when a pump portion of the cartridge is compressed. A movable compression member in the dispenser can be located at a first position adjacent the pump portion of the first cartridge or at a second position adjacent the pump portion of the second cartridge. A knob extending outside the dispenser is connected to the compression member for moving the compression member to the first position or to the second position to thereby select the cartridge to be dispensed from. When a movable dispensing member of the dispenser is operated, it causes only the cartridge pump portion that is adjacent the compression member to be compressed between the compression member and an opposed pinch surface in the dispenser thereby dispensing fluid from the cartridge.

7 Claims, 4 Drawing Sheets

DUAL LIQUID CARTRIDGE DISPENSER

This application is a continuation of application Ser. No. 110,151, filed Oct. 19, 1987 now abandoned.

TECHNICAL FIELD

This invention relates to viscous liquid dispensers and, in particular, to a dispenser containing at least two disposable cartridges of the viscous liquid with means for selectively dispensing only from a single cartridge at any one time.

BACKGROUND ART

Within the past ten years, it has become fairly common to package certain viscous liquids, such as soaps, shampoos and like products, in disposable cartridges and to dispense such liquids from dispensers in places like public washrooms, and hotel and motel bathrooms. Although the detailed construction of the disposable cartridges may differ, they generally include a compressible pump portion and an exit orifice for the liquid. When pressure is applied to the pump portion of the cartridge, liquid is forced through the exit orifice, into the user's hand. The dispensers that accept such disposable liquid cartridges have a manually operated dispensing member, such as a pivoted lever, for pressing the pump portion of the cartridge against a compression surface in the dispenser. A typical prior art viscous liquid dispenser is disclosed in U.S. Pat. No. 4,130,224-Norman, et al., assigned to the assignee of the present invention. The dispenser of Norman, et al. is used to dispense liquids such as soap from a single disposable cartridge. The Norman, et al. dispenser has a sight window located adjacent to the bottom of the disposable cartridge so that a maintenance person can see that the cartridge needs to be replaced. One problem with the single cartridge dispenser is that when the maintenance person looks at the window, the level of the fluid may be only slightly above the window with the result that the cartridge is completely used up before the maintenance person returns to service the dispenser. Another common occurrence is that if the maintenance person observes that the liquid level in the cartridge is just below the top edge of the sight port, the maintenance person may replace the cartridge rather than take the chance that the cartridge will empty before the dispenser is next serviced. This, of course, can lead to a considerable waste of the liquid soap or other product. Thus, it would be desirable to have a dispenser that holds two disposable cartridges so that the user can completely exhaust one cartridge and then begin immediately dispensing from the second cartridge.

One approach for dispensing from two cartridges is suggested by U.S. Pat. No. 4,513,885-Hogan which discloses packaging two single cartridge dispensers side by side to form a dispensing system. One problem with adopting this concept for a liquid soap dispenser is that since the user can dispense from either dispenser it is possible for both cartridges to empty at the same time. Thus, it can be seen that it would be desirable to have a dual cartridge dispensing system which prevents the user from dispensing from one cartridge until the other cartridge is completely empty.

U.S. Pat. No. 2,691,386-Dalrymple discloses a trigger operated spray gun for simultaneously spraying two liquid solutions onto an object. At column 5, lines 49–68, Dalrymple describes a trigger operated mechanism that simultaneous opens or closes a pair of fluid passages. At column 6, lines 33–40, Dalrymple provides for individual adjustment of the fluid flow through each fluid passageway.

It is an object of this invention to provide a dispenser for two or more disposable, viscous liquid cartridges wherein the probability that the dispenser will empty before it can be serviced is greatly reduced.

Another object of this invention is to provide a dispenser, having two disposable liquid cartridges, that can only dispense from one cartridge at a time.

BRIEF DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

Figure 4:
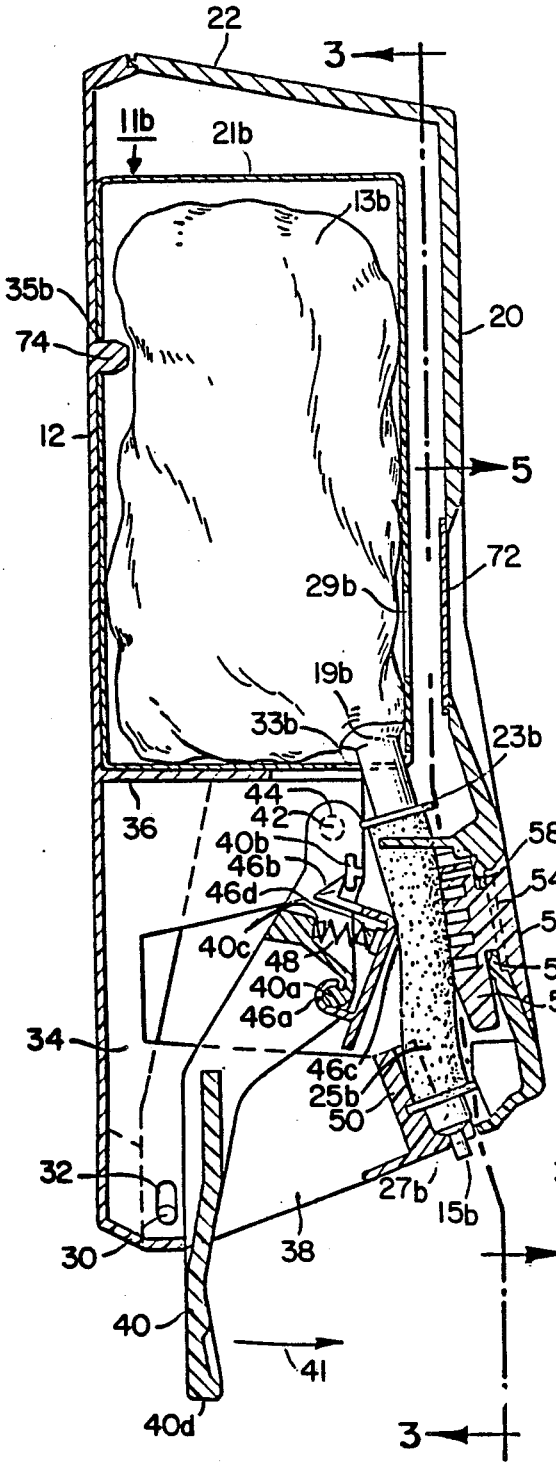
FIG. 4 is a sectional side elevation view taken along the line 4—4 of FIGS. 2 and 3.
Figure 6:
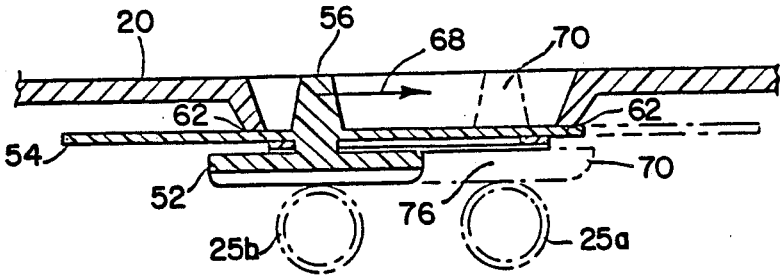
Figure 5:
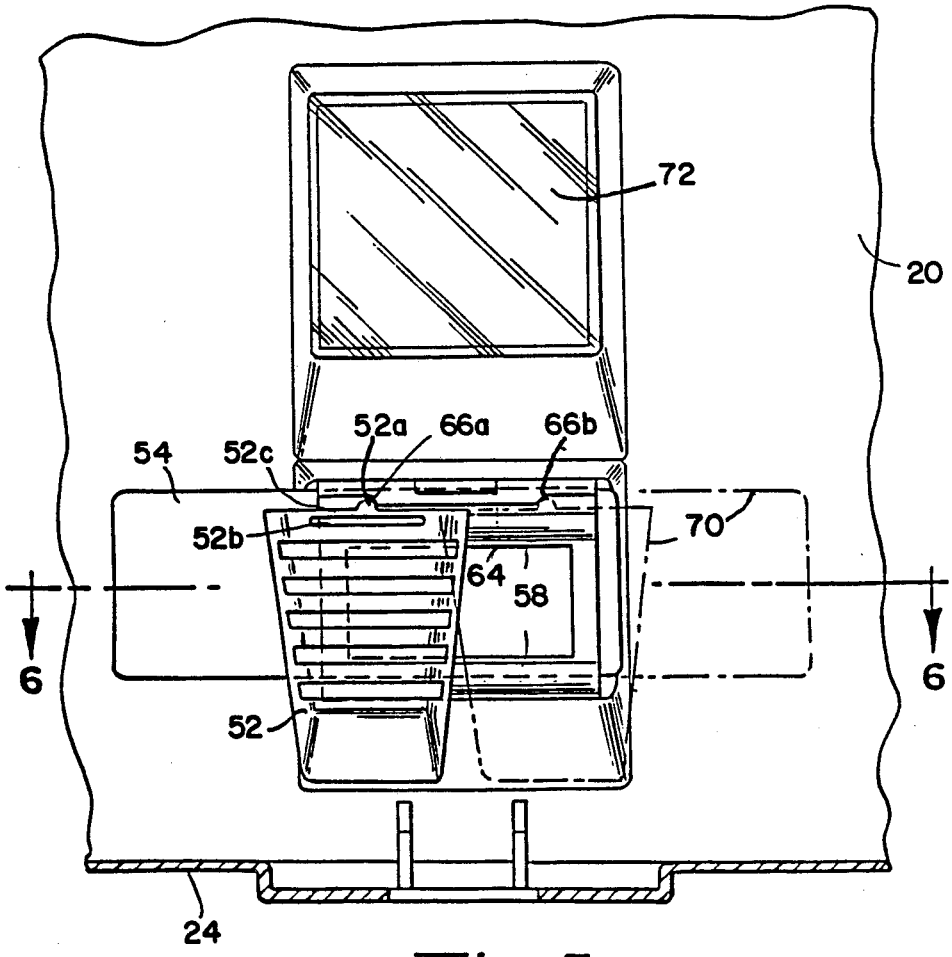

FIG. **4*a*** is a partial sectional side elevation view illustrating the compression of the cartridge pump assembly;

FIG. 5 is a partial sectional view taken along the line 5—5 of FIG. 4; and FIG. 6 is a sectional view taken along the line 6—6 of FIG. 5.

DISCLOSURE OF THE INVENTION

In accordance with the invention there is provided a dispenser that can support two disposable liquid cartridges, each cartridge having an exit orifice through which fluid is dispensed when a pump portion of the cartridge is compressed. The dispenser has a movable compression member located in the apparatus having a first position adjacent the pump portion of the first cartridge and having a second position adjacent the pump portion of the second cartridge. The movable compression member is connected to a knob extending outside the dispenser which is used to move the compression member to the first position or to the second position to thereby select the cartridge that is compressed. The dispenser has a movable dispensing member which compresses between the compression member and an opposing pinch surface in the dispenser only that cartridge pump portion that is adjacent the compression member.

BEST MODE FOR CARRYING OUT THE INVENTION

Figure 1:
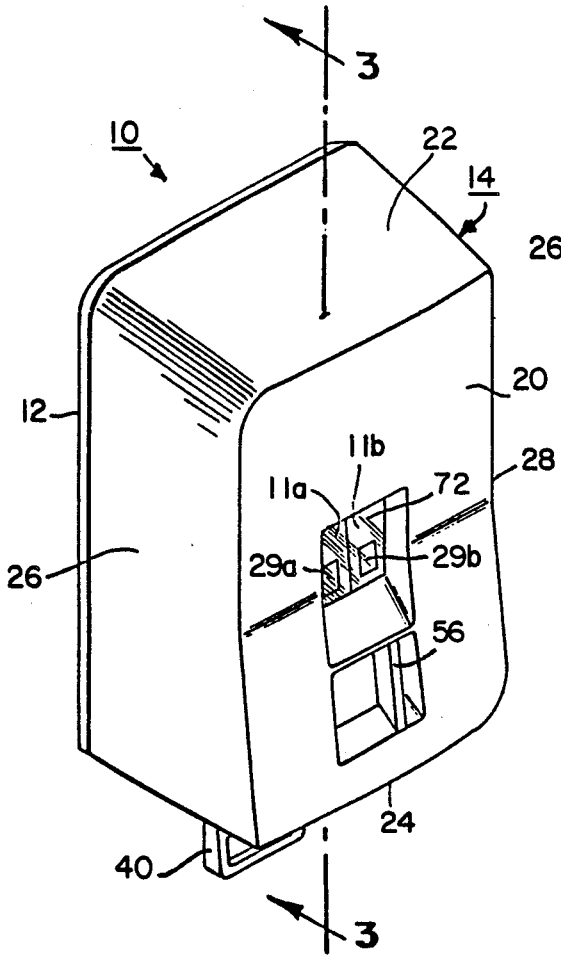
FIG. 1 is a perspective view of the dual liquid cartridge dispenser of this invention.
Figure 4A:
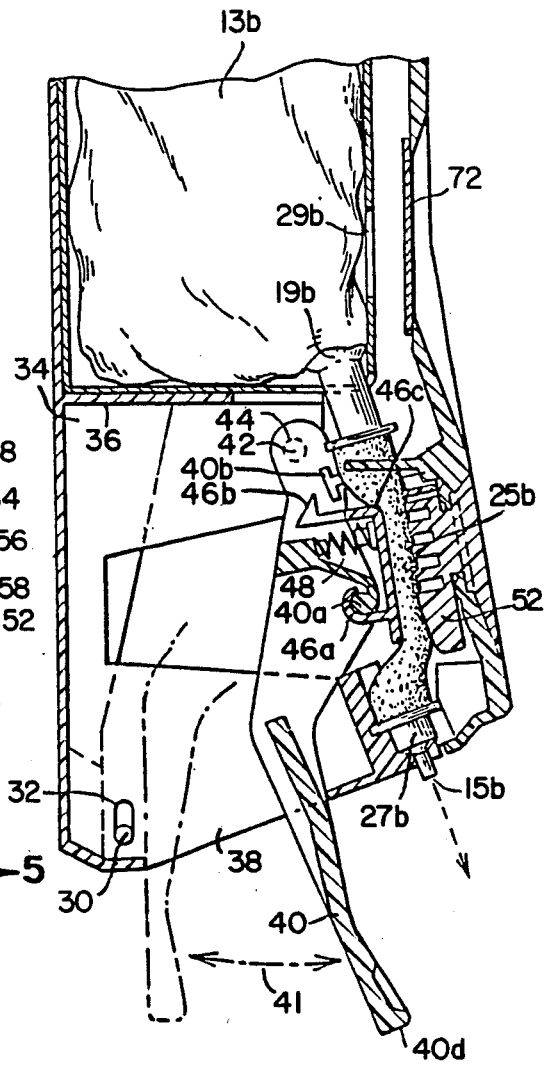

For the sake of convenience, an element depicted in more than one figure will retain the same element number in each figure. Referring now to FIG. 1, the dispenser 10 of this invention has a rear base member 12, a front face 20, a top wall 22, bottom wall 24 and side walls 26, 28. The base 12 is provided with a number of mounting holes, not shown, so that it can be mounted by means of bolts to a wall behind a washroom sink. In a preferred embodiment, the front wall 20, top wall 22, bottom wall 24, and side walls 26, 28 of the dispenser 10 form a cover 14 that, as best illustrated in FIGS. 4 and 4a, is pivotally connected to the base 12 by means of short hinge pins 30 on the cover 14 which extend into pivot holes 32 in support member 34 of base 12. Also attached to the base 12 is a shelf 36 for supporting two disposable viscous liquid cartridges 11a and 11b, such as soap or shampoo, side by side in the dispenser 10.

Figure 3:
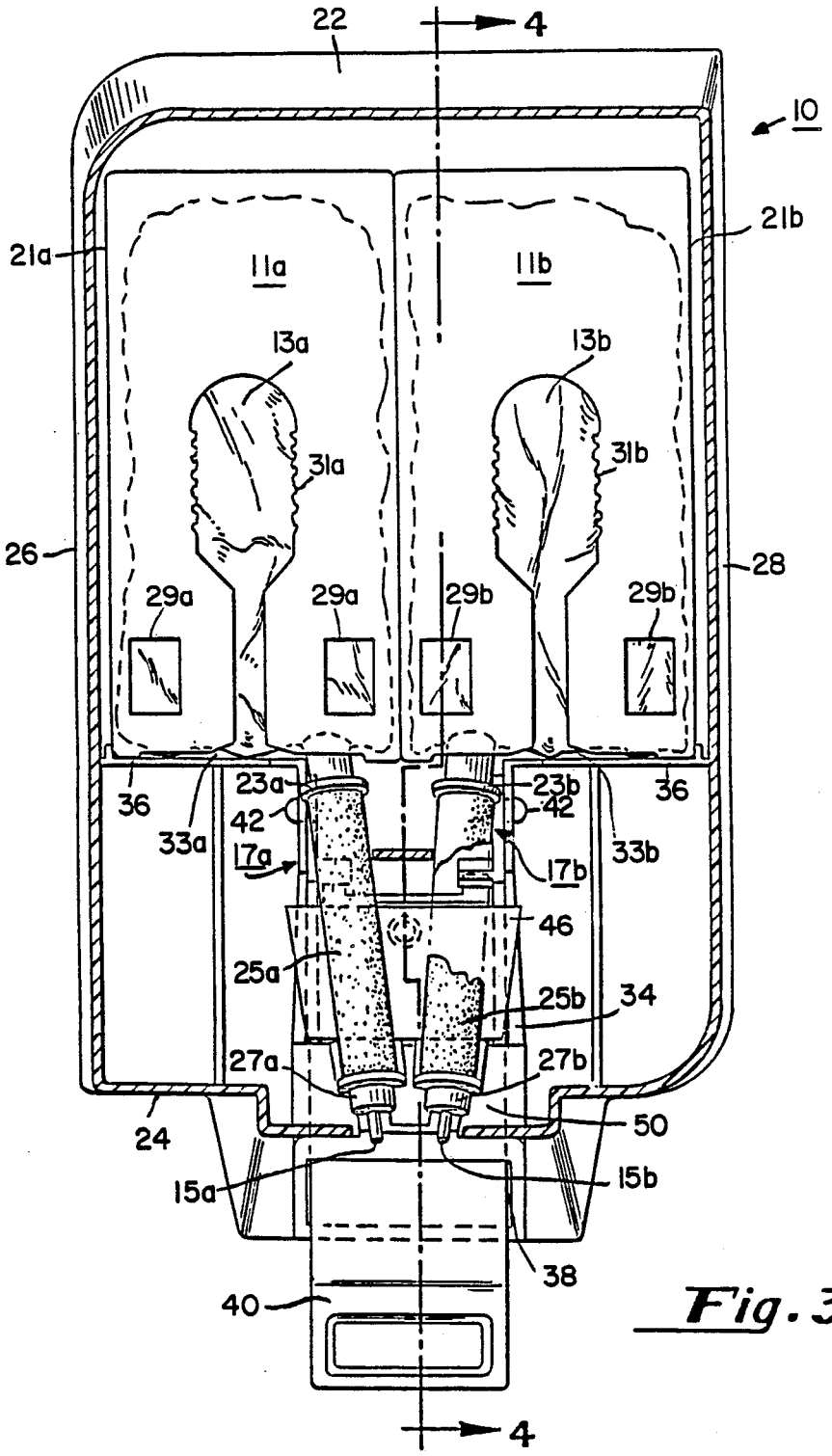
FIG. 3 is a front sectional view taken along the line 3—3 of FIGS. 1 and 4.

As best shown in FIG. 3, a typical viscous liquid cartridge 11 includes a flexible bag 13, a pump assembly portion 17 and a paperboard box 21 for controlling the shape of the flexible bag 13 both in the dispenser 10 and during shipment. The pump assembly 17 consists of a connector element 23, a flexible tube 25 having one end connected to the connector 23 and the other end connected to a discharge element 27 which includes exit orifice 15 through which the liquid is dispensed. In a preferred embodiment, the discharge element 27 includes a normally closed, spring loaded, ball valve as described in the aforementioned patent to Norman, et al. As best shown in FIGS. 4 and 4a, a fitment 19b attached to the bottom of the flexible bag 13b provides an outlet port through which liquid can flow out of flexible bag 13b. The connector element 23b of pump assembly 17b is inserted into the fitment 19b to provide fluid flow from the flexible bag 13b into the pump assembly 17b. The filled flexible bag 13b, and attached pump assembly 17b are packaged inside the paperboard box 21b for shipment.

Referring now to FIGS. 4 and 4a, a handle 40, or dispensing means, is pivotally connected to the base 12 by means of short hinge pins 42 which extend into pivot holes 44 in support member 34 just below the shelf 36. The support member 34 has a central opening 38 and the handle 40 is mounted so that it extends through the central opening 38 with the end 40d spaced a short distance below the bottom of the dispenser 10. Assembled to the handle 40 is a spring loaded, pivoted pinch block 46. Pinch block 46 has a pair of hooks 46a which fit around a bar element 40a of handle 40 so that the pinch block 46 can pivot around the bar element 40a. Spring 48 mounted between the handle 40 and the pinch block 46 biases two tabs 46b of the pinch block 46 against corresponding stops 40b on the handle 40. A spring retaining box 40c on the handle 40 and spring retaining boss 46d on the pinch block 46 act to retain the spring 48 within the assembly. Assembled to the lower, front part of support 34 is a discharge element holder 50 into which the discharge elements 27 of two cartridges 11 are held.

Referring now to FIGS. 4, 4a, 5 and 6, mounted within the cover 14 is a movable compression block 52. A slide plate 54 is affixed to the compression block 52 and a knob 56 to provide a movable compression means. The upper and lower edges of slide plate 54 move in slide tracks formed between horizontal guide walls 58 and inner surfaces 62 of cover 14. As best shown in FIG. 5, the sloping side 66a of ledge 64 cooperate with a raised projection 52a on the upper edge 52c of compression block 52 to fix the location of the compression block 52 adjacent to the flexible tube 25b of cartridge 11b. When a force is applied to the knob 56 in the direction of arrow 68, the sloped side 66a applies a compressive force to projection 52a and, because of slot 52b, the upper edge 52c of the compression block 52 yields to allow the projection 52a to slide along ledge 64. When the movable compression means reaches the position represented by the dashed lines 70, the projection 52a rides up the sloped side 66b which retains the removable compression block 52 in a second position adjacent the flexible tube 25a of the pump assembly 17a of the other cartridge 11a.

Figure 2:
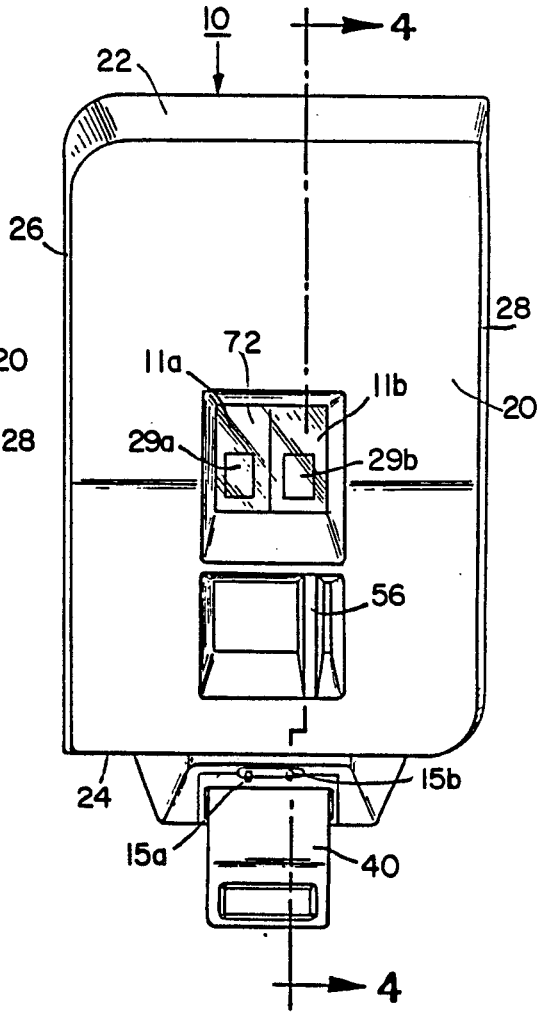
FIG. 2 is a front elevational view of the dispenser.

Referring now to FIGS. 1 and 2, the dispenser 10 has a viewing window 72 located in the center of the front face 20 of the dispenser. The viewing window 72 is located above knob 56 and even with the lower portion of the cartridges 11a and 11b supported in the dispenser 10. As best shown in FIG. 3, each box 21 has two small rectangular cutouts 29 at the front lower corners of the box 21. When the cartridge 11 is placed in the dispenser 10, the bottom of the flexible bag 13 of the two cartridges 11 are visible through the viewing window 72.

A typical operating sequence will now be described. The cover 14 is unlocked, or unlatched as the case may be, and pivoted down about hinge pins 30. Spent cartridges 11 are removed and replacement cartridges 11 are prepared by tearing out the vertical front wall strips 31 and the bottom wall strips 33, shown in FIG. 3, from cartridge boxes 21. Removal of those strips 31, 33 allows the pump assemblies 17 to be withdrawn from the boxes 21 so that they extend down from the lower left or lower right portion of the box 21 depending upon whether the cartridge 11 is placed on the support shelf 36 in the left or right position. As best shown in FIG. 4, the rear wall 12 of dispenser 10 has two locating bosses 74 which fit into a locating hole 35 in the cartridge box 21 so that the two cartridges 11a and 11b are precisely positioned in the dispenser. Locating bosses 74 also prevent shifting of the cartridges 11a and 11b in the dispenser 10 when replacing cartridges. The discharge element 27 of each cartridge 11 is placed into the discharge element holder 50. As best shown in FIG. 3, when the discharge elements 27a and 27b of the cartridges 11a and 11b are fixed in place the bore of the discharge orifices 15 make a slight angle with the vertical so that fluid discharged from the orifices 15 is directed toward a common point at the same level as lower edge 40d of the handle 40.

The cover 14 is now pivoted upward to close the dispenser 10. With the knob 56 placed to the right as shown in FIG. 2, the movable compression block 52 will be located adjacent the pump assembly 17b of cartridge 11b. Dispensing of the fluid from cartridge 11b commences by a user placing his hand palm upward with his fingertips behind the handle 40 and moving handle 40 in the direction indicated by arrow 41 in FIG. 4. As handle 40 is moved to the position indicated in FIG. 4a, pinch surface 46c of pinch block 46 first pinches the upper portion of flexible tube 25b against compression block 52 to seal the tube 25b and prevent any back flow of fluid from the lower portion of pump assembly 17b into the flexible bag 13b. Once the upper portion of the flexible tube 25b has been pinched off, further forward motion of handle 40 results in pinch block 46 rotating about bar 40a and compression of spring 48 so that pinch block 46 builds up fluid pressure in the lower part of pump assembly 17b thereby causing fluid to be expelled through the exit orifice 15b into the palm of the user.

When the user releases the handle 40, spring 48 returns the pinch block 46 to the biased position with tabs 46b of pinch block 46 in contact with stop surfaces 40b of handle 40 which causes handle 40 to be returned to the position shown in FIG. 4. As best shown in FIG. 6, when the movable compression block 52 is positioned adjacent the flexible tube 25b of cartridge 11b, there is a space 76 between the flexible tube 25a of cartridge 11a and the nearest inside wall of cover 14. The space 76, which is the thickness of movable compression block 52, is such that the forward motion of the pinch block surface 46c cannot completely pinch off the flexible tube 25a of cartridge 11a and will not cause fluid to be dispensed from cartridge 11a. When a user observes that cartridge 11b is empty, he can move knob 56 in the direction of arrow 68 in FIG. 6 to position the compression block 52 adjacent flexible tube 25a of cartridge 11a. Dispensing from cartridge 11a can now take place. When the maintenance person comes to service the dispenser 10, he will observe through the window 72 that the cartridge 11b is empty and can replace it with a new cartridge 11b.

While the present invention has been described with reference to a specific embodiment thereof, it will be obvious to those skilled in the art that various changes and modifications may be made without departing from the invention in its broader aspects. For example, it is possible to mount the spring loaded pinch block 46 on the cover 14 and the movable compression block 52 on the handle 40. This could be accomplished by providing the compression block 52 with a portion that extends behind the handle 40 and by providing the knob 56 with two arms that extend around and behind the handle 40 so that the arms move the compression block 52 from behind the handle 40 when the knob 56 is moved. Also, although the cartridge 11 is compressed with a first pinching action followed by a compression action, that is due to the design of the pump assembly portion 17. The principles of this invention can be used in dispensers for cartridges 11 that have a pump portion 17 that require only compression to cause dispensing of the fluid. It is contemplated in the appended claims to cover all variations and modifications of the invention which come within the true spirit and scope of the invention.

What is claimed as new and desired to be secured by Letters Patent of the United States is:

1. An apparatus for dispensing a viscous liquid from two disposable cartridges, each cartridge having an exit orifice through which fluid is dispensed when a pump portion of the cartridge is compressed, the apparatus comprising:

(a) means in the apparatus for supporting the two cartridges;

(b) a movable compression member located in the apparatus having a first position adjacent the pump portion of the first cartridge and remote from the pump portion of the second cartridge, and having a second position adjacent the pump portion of the second cartridge and remote from the pump portion of the first cartridge;

(c) a knob extending outside the apparatus and connected to the compression member for moving the compression member to the first position or to the second position in such manner that the compression member is moved out of the first position in response to movement thereof to the second position and vice versa, thereby selecting only a single one of the two cartridges to be compressed; and (d) a movable dispensing member mounted in the apparatus which compresses between the compression member and an opposed pinch surface in the apparatus only that single cartridge pump portion that is adjacent the compression member thereby causing fluid to be dispensed from the exit orifice of the selected cartridge.

2. The apparatus of claim 1 wherein the pinch surface is located on the movable dispensing member.

3. The apparatus of claim 1 wherein the pinch surface is located on the movable dispensing member.

4. The apparatus of claim 1 wherein the pump portion of each cartridge comprises a resilient tube having the exit orifice at one end, the apparatus further comprising means for holding the exit orifice of both tubes so that fluid pumped out of each orifice is directed to a common point below the orifices.

5. The apparatus of claim 2 wherein the pump portion of each cartridge comprises a resilient tube having the exit orifice at one end, the apparatus further comprising means for holding the exit orifice of both tubes so that fluid pumped out of each orifice is directed to a common point below the orifices.

6. The apparatus of claim 3 wherein the pump portion of each cartridge comprises a resilient tube having the exit orifice at one end, the apparatus further comprising means for holding the exit orifice of both tubes so that fluid pumped out of each orifice is directed to a common point below the orifices.

7. The apparatus of claim 1, wherein the compression member is horizontally slidable between the first and second positions.

* * * * *